US006892851B2

(12) United States Patent
Lee

(10) Patent No.: US 6,892,851 B2
(45) Date of Patent: May 17, 2005

(54) ACOUSTIC ATTENUATOR

(75) Inventor: Peng Lee, University, MS (US)

(73) Assignee: Acoustic Horizons, Inc., Pleasanton, CA (US)

( * ) Notice: Subject to any disclaimer, the term of this patent is extended or adjusted under 35 U.S.C. 154(b) by 0 days.

(21) Appl. No.: 10/691,456

(22) Filed: Oct. 22, 2003

(65) Prior Publication Data

US 2004/0134712 A1 Jul. 15, 2004

Related U.S. Application Data

(63) Continuation of application No. 09/875,792, filed on Jun. 6, 2001, now Pat. No. 6,668,970.

(51) Int. Cl.[7] ..... E04F 17/04; F01N 7/00; F01N 1/24; F01N 1/10; F24F 13/24

(52) U.S. Cl. ..... 181/224; 181/225; 181/222; 181/270; 165/135; 454/906

(58) Field of Search ..... 181/224, 225, 181/210, 217, 222, 264, 281, 270, 290, 295; 165/135, 69, DIG. 313; 454/252, 906

(56) References Cited

U.S. PATENT DOCUMENTS 2,176,319 A * 10/1939 Anderson ..... 181/224
3,110,357 A * 11/1963 Jenn et al. ..... 181/224
4,146,112 A * 3/1979 Usry ..... 181/281
4,266,602 A * 5/1981 White et al. ..... 181/224
4,660,676 A * 4/1987 Eustace ..... 181/224
4,665,549 A * 5/1987 Eriksson et al. ..... 181/222
4,986,170 A * 1/1991 Ramakrishnan et al. .... 181/224
5,332,872 A * 7/1994 Ewanek ..... 181/224
5,728,979 A * 3/1998 Yazici et al. ..... 181/224
5,856,640 A * 1/1999 Lynn ..... 181/218
5,983,888 A * 11/1999 Anselmino et al. ..... 454/906
6,145,616 A * 11/2000 Ewanek ..... 181/224
6,537,490 B2 * 3/2003 Han ..... 181/224

FOREIGN PATENT DOCUMENTS

JP 06257796 A * 9/1994 ..... F24F/5/00

* cited by examiner

*Primary Examiner*—Edgardo San Martin
(74) *Attorney, Agent, or Firm*—Van Pelt, Yi & James LLP

(57) ABSTRACT

An acoustic attenuator includes an intake air duct having an intake air duct opening leading to an outside environment and a blower fan opening leading to a blower fan. Air is drawn through the intake air duct opening towards the blower fan and a primary reflecting panel disposed in the intake air duct. The primary reflecting panel is configured to reflect sound propagated from the blower fan away from the intake air duct opening.

9 Claims, 14 Drawing Sheets

ACOUSTIC ATTENUATOR

This is a Continuation of application Ser. No. 09/875,792, filed Jun. 6, 2001 now U.S. Pat. No. 6,668,970, which is hereby incorporated by reference.

FIELD OF THE INVENTION

This invention relates to acoustics. More specifically, reducing sound in an HVAC system is disclosed:

BACKGROUND OF THE INVENTION

Mechanical air control equipment of a Heating Ventilation and Air Conditioning (HVAC) system can be a major source of sound in a building. The sound generated by the HVAC system travels both upstream and downstream in the intake air duct and exhaust air duct, respectively. Various sound sources within the duct include blower fans, diffusers, airflow regulating valves, etc. Noise generated by the blower fans is of broad band frequency, typically ranging from about 200 Hz through the rest of the frequency range of human hearing. Therefore, noise generated by HVAC system, when travelling upstream through the very short intake air duct, exits the intake air filter and enters the building living area creating a noise pollution problem.

A cost-efficient HVAC system often requires placing the HVAC heat exchange system in the middle of a building. This exchange system is often placed in a hallway, which frequently leads to a family room, dining room, bedroom, kitchen, etc. Noise generated by the HVAC blower fan and other mechanical parts travels through the short section of the intake air duct and enter the living space. This noise pollution makes normal conversation and comfortable television listening difficult.

Various attempts have been made to minimize the sound generated by an HVAC system. However, these attempts generally address the treatment at the exhaust air duct section, and not the treatment at the intake air duct section. Because the intake air duct section is usually a very short section of the air duct, it leaves very little space for any effective noise treatment. One exhaust air duct treatment system is commonly referred to as a dissipative silencer, which provides a noise attenuating liner either inside or outside the duct. This liner may be mineral wool or fiberglass insulation. These materials moderately attenuate sound over a broad range of frequencies. However, these liners are often not desirable because of large space requirements and the extended length of coverage that is required to produce adequate attenuation.

Additionally, reactive silencers have been used to attenuate sound. They typically consist of perforated metal facings that cover a plurality of tuned chambers. Generally, reactive silencers attenuate low frequency noise. Broad band attenuation is more difficult to achieve with reactive silencers, due to the larger area required to achieve a noticeable result. Another way to reduce the noise in an exhaust duct is by employing an acoustic resonator. This technique includes at least one resonating chamber having walls that define a length and a height. The length of the resonating chamber is selected to provide noise attenuation at a predetermined frequency. Generally, acoustic resonators only attenuate a predetermined frequency or frequencies. To achieve broad band frequency attenuation with an acoustic resonator requires a large number of different lengths and sizes of resonating chambers, which, in turn, requires a large area and volume of work space.

All of the above mentioned noise-attenuating techniques require a large area and volume of workspace which is only possible in the exhaust duct area. The usually short intake air duct provides too small an area for the previous designs to effectively attenuate broad band HVAC noise.

Another attempt to reduce noise is by active noise attenuation. This is accomplished by sound wave interference. Undesirable noise propagating within a duct is attenuated by the introduction of a canceling sound. An input microphone typically measures the undesirable noise up stream in a duct and converts it to an electrical signal. The signal is processed by a digital computer that generates a sound wave of equal amplitude and 180 degrees out of phase (a mirror image of the noise). This secondary noise source destructively interferes with the noise and cancels a significant portion of the unwanted noise. However, the adaptive process that is used to generate the canceling signal can be adversely affected by acoustical reflection from distant elements in the overall duct system. Active attenuation is only useful on low frequency (below about 100 Hz) noise attenuation and is not efficient in attenuating higher frequencies. Additionally, the high cost of this system further limits its use.

SUMMARY OF THE INVENTION

An acoustical reflective and dissipative attenuation system is disclosed that is used to reduce broad band noise in the intake air duct (also referred to as a return air duct) of an HVAC heat exchange system. In many cases, the intake air duct is a very short section of the air duct system with very limited workspace, generally less than 20 cubic feet in volume. Significant broad band noise reduction is achieved by appropriately placing a noise-reflecting panel (shield) with an appropriate amount of acoustic absorbing padding at a strategic location. The reflecting panel contains the noise in the intake air duct section and greatly increases the noise absorption by the acoustic absorbing padding before this noise can exit the intake air duct filter and enter the living area of a building.

It should be appreciated that the present invention can be implemented in numerous ways, including as a process, an apparatus, a system, a device, a method, or a computer readable medium such as a computer readable storage medium or a computer network wherein program instructions are sent over optical or electronic communication links. Several inventive embodiments of the present invention are described below.

In one embodiment, an acoustic attenuator includes an intake air duct having an intake air duct opening leading to an outside environment and a blower fan opening leading to a blower fan wherein air is drawn through the intake air duct opening towards the blower fan and a primary reflecting panel disposed in the intake air duct, the primary reflecting panel being configured to reflect sound propagated from the blower fan away from the intake air duct opening.

In one embodiment, an acoustic attenuator module configured to be housed within an intake air duct having an intake air duct opening includes an open end having sides configured to be attached to passageway leading from the intake air duct to a blower fan; primary reflecting side configured to reflect sound propagating from the blower fan through the open end away from the intake air duct opening; and an open side configured to allow from the air intake air duct opening to circulate around the module through the open side and the open end to the blower fan.

In one embodiment, an acoustic attenuator module configured to be housed within an intake air duct having an intake air duct opening includes an open end having sides configured to be attached to passageway leading from the intake air duct to a blower fan; an open side configured to allow from the air intake air duct opening to circulate through the module through the open end to the blower fan; and a primary reflecting plate offset from the open side to block noise propagated from the blower fan from propagating through the open side.

In one embodiment, sound propagating from a blower fan into a living space through an intake air duct having an intake air duct opening is attenuated by reflecting sound propagated from the blower fan away from the intake air duct opening using a primary reflecting panel in the intake air duct.

These and other features and advantages of the present invention will be presented in more detail in the following detailed description and the accompanying figures which illustrate by way of example the principles of the invention.

BRIEF DESCRIPTION OF THE DRAWINGS

The present invention will be readily understood by the following detailed description in conjunction with the accompanying drawings, wherein like reference numerals designate like structural elements, and in which.

The present invention can be better understood from the detailed description with the accompanying drawings, in which.

DETAILED DESCRIPTION

A detailed description of a preferred embodiment of the invention is provided below. While the invention is described in conjunction with that preferred embodiment, it should be understood that the invention is not limited to any one embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention. The present invention may be practiced according to the claims without some or all of these specific details. For the purpose of clarity, technical material that is known in the technical fields related to the invention has not been described in detail so that the present invention is not unnecessarily obscured.

Figure 1:
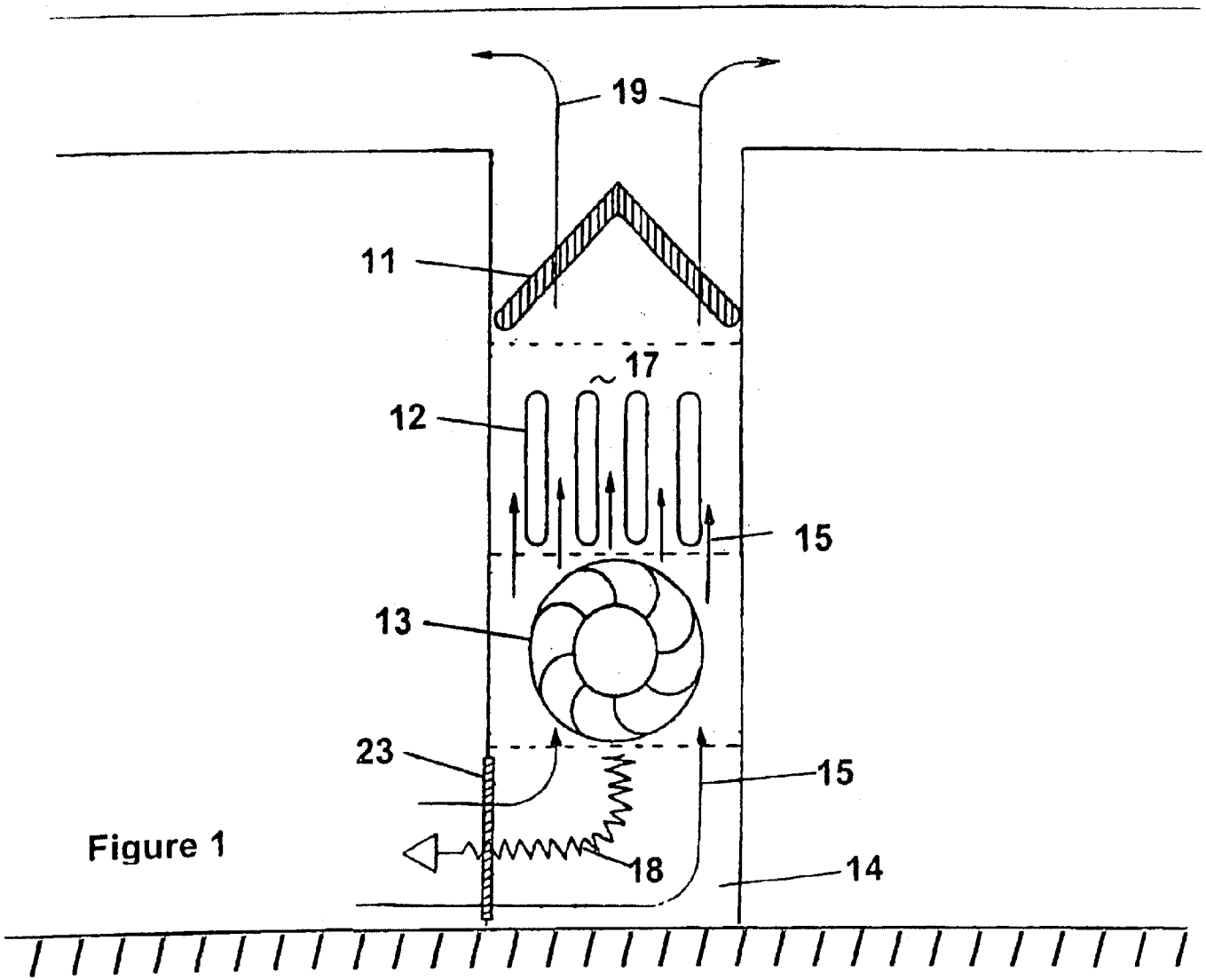
FIG. 1 is an illustration of an HVAC heat exchange system.

A general layout of a household HVAC heat exchange system is shown in FIG. 1. The HVAC system includes an air conditioner cooling coil/heat exchanger 11, gas furnace heat exchange panels 12, a blower fan 13, and an intake air duct section 14. These four sections form a passageway 17 through which air flows in a direction indicated by arrows 15. The blower fan sucks in air from the building living area through the intake air filter 23 forcing the air to pass through the gas furnace heat-exchanging panels 12 and the air conditioner cooling coil/heat exchanger 11. The renewed air 19 is then distributed throughout the building. Noise 18 generated by the blower fan and other mechanical parts can easily travel through the short section of intake air duct 14 and exit through the intake air filter 23 and enter living area with very little of its energy impeded. In one embodiment, the acoustic attenuator is installed in the limited space of intake air duct 14 by attaching it directly under the lower section of the blower fan 13.

Figure 2A:
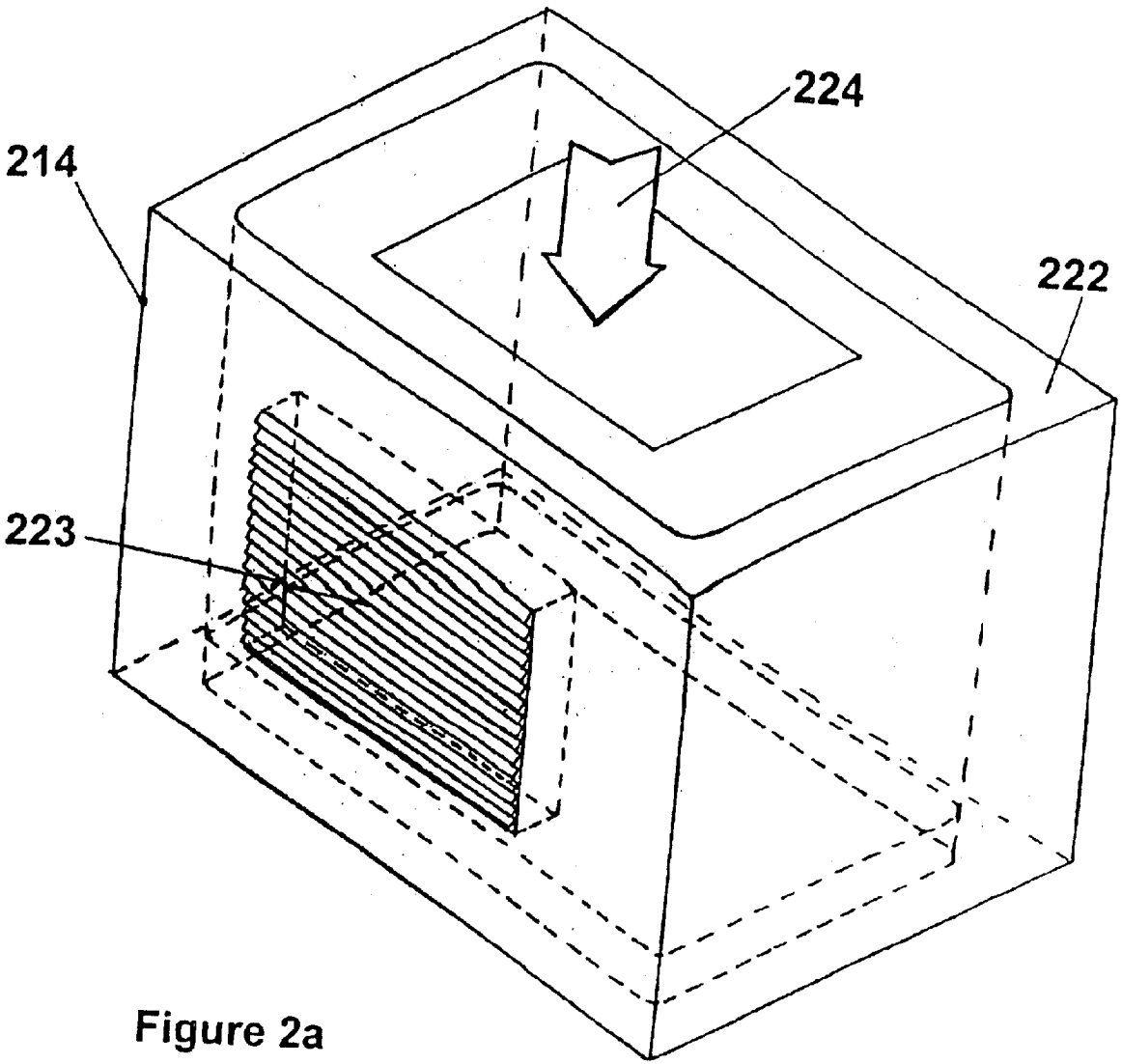
FIG. 2A is a three dimensional view of the intake air duct section with an acoustic absorbing padding lining.

FIG. 2A is a three dimensional view of an intake air duct 14 with acoustical absorbing padding 222 added to the inside walls. Noise 224 generated by a blower fan and other mechanical parts travels through this duct section, exits the intake air filter 223 and enters the living area. The acoustical absorbing padding attenuates the noise somewhat.

Figure 2B:
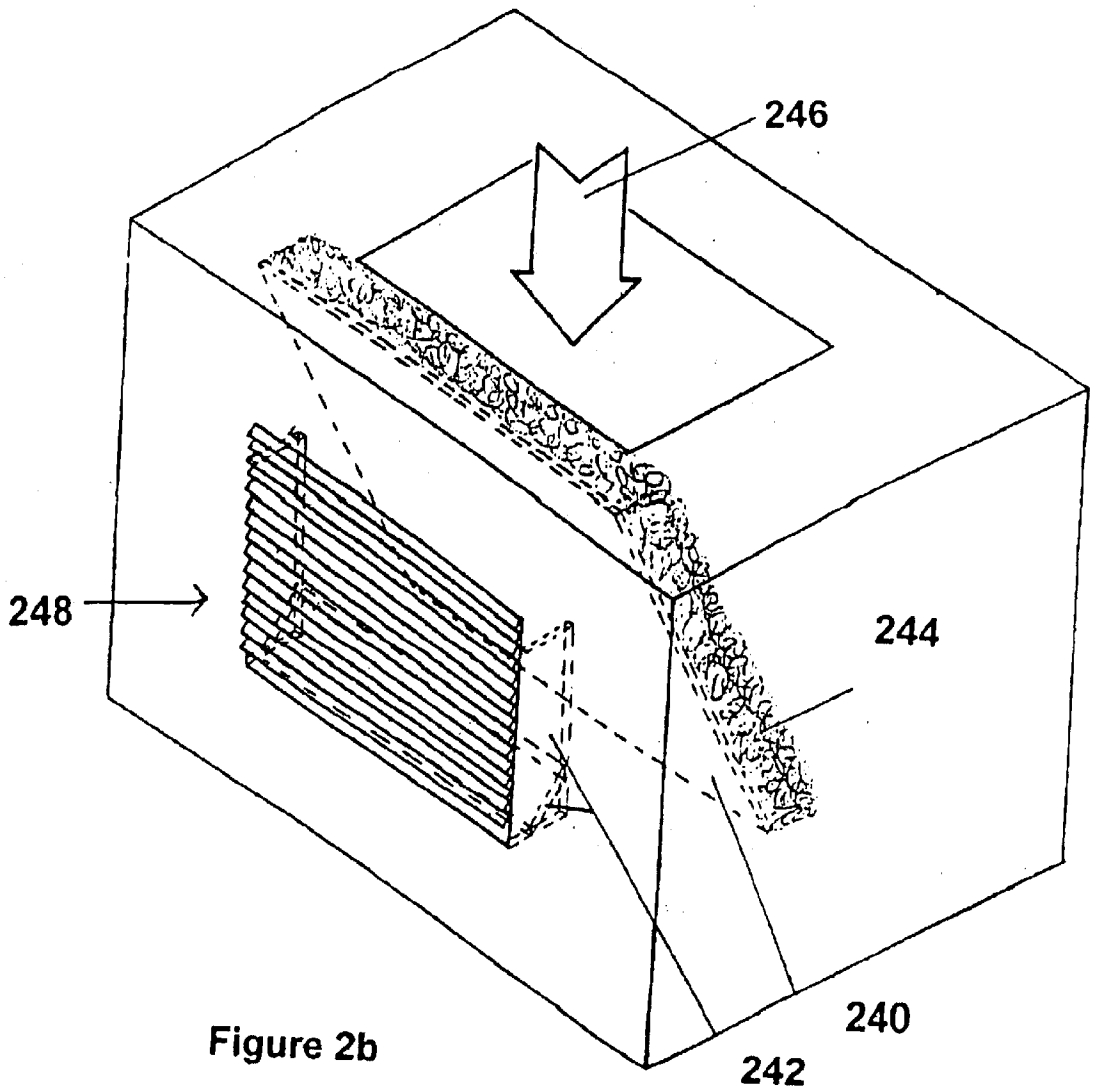
FIG. 2B is a three dimensional view of the intake air duct section with primary and secondary reflecting panels installed.

FIG. 2B is a three dimensional view of the intake air duct section with a primary reflecting panel 240 and secondary reflecting panels 242 installed. Primary reflecting panel 240 can be made out of plywood or sheet metal and covered with acoustical absorbing padding 244. When the primary reflecting panel is installed at an appropriate location, it reflects noise 246 away from intake air filter opening 248 and back into the intake air duct. This action augments the noise absorption by acoustical absorbing padding 244. To augment the effect of primary reflecting panel 240, secondary reflecting panels 242 are included at the sides and bottom of the air filter opening 248. The reflecting panels reflect sound back toward the blower fan while allowing air flow from the intake air duct opening to pass around the reflecting panels to the blower fan.

Figure 3A:
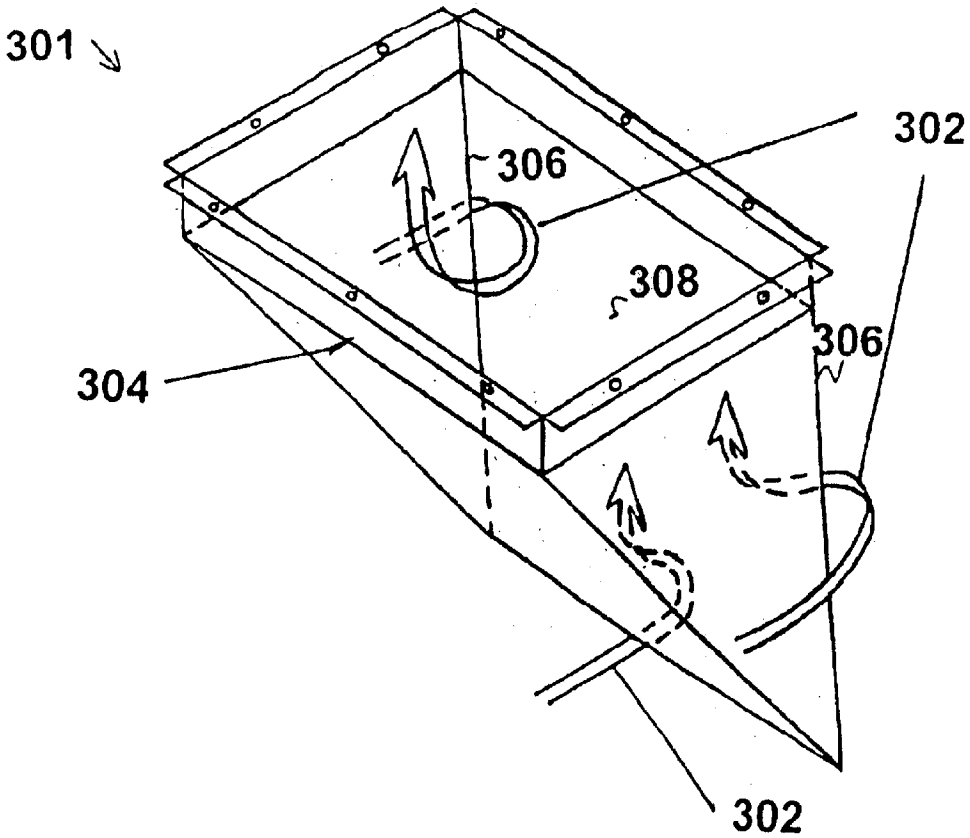
FIG. 3A is a three dimensional view of a triangular module.

FIG. 3A is a diagram illustrating a triangular acoustic attenuator module that attenuates noise in a similar manner as the primary and secondary reflecting panels attenuate noise. The triangular module 301 may be constructed using a single sheet of galvanized metal. The direction of the airflow is indicated by the arrows 302. Noise from a blower fan is reflected off of primary panel 304 and secondary side panels 306. Air from the intake air duct opening circulates around the reflecting panels and through the open side 308 upward to the blower fan. When the triangular module is covered with an acoustical absorbing padding and installed directly under the blower fan as shown in FIG. 3B, the noise attenuation is significant.

Figure 3B:
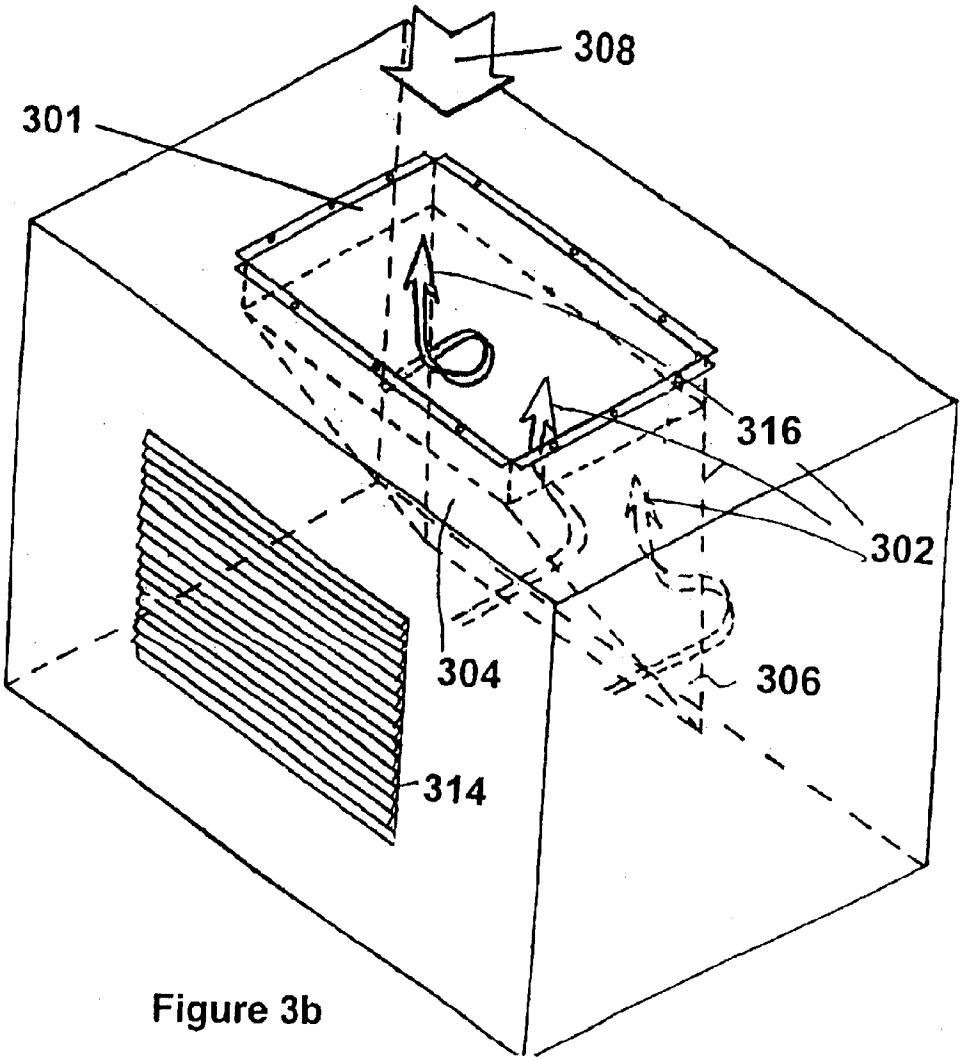
FIG. 3B is a three dimensional view of how a triangular module is installed under the blower fan.

FIG. 3B is a three dimensional view of how a triangular module is installed directly under the blower. Module 301 is bolted to the sides of an opening leading to the blower so that it extends downward into the intake air duct. Noise from the blower fan is reflected off of reflecting panels 304 and 306 and air 302 from the intake air duct opening 314 circulates around the reflecting panels and through open side 308 upward to the blower fan.

Figure 3C:
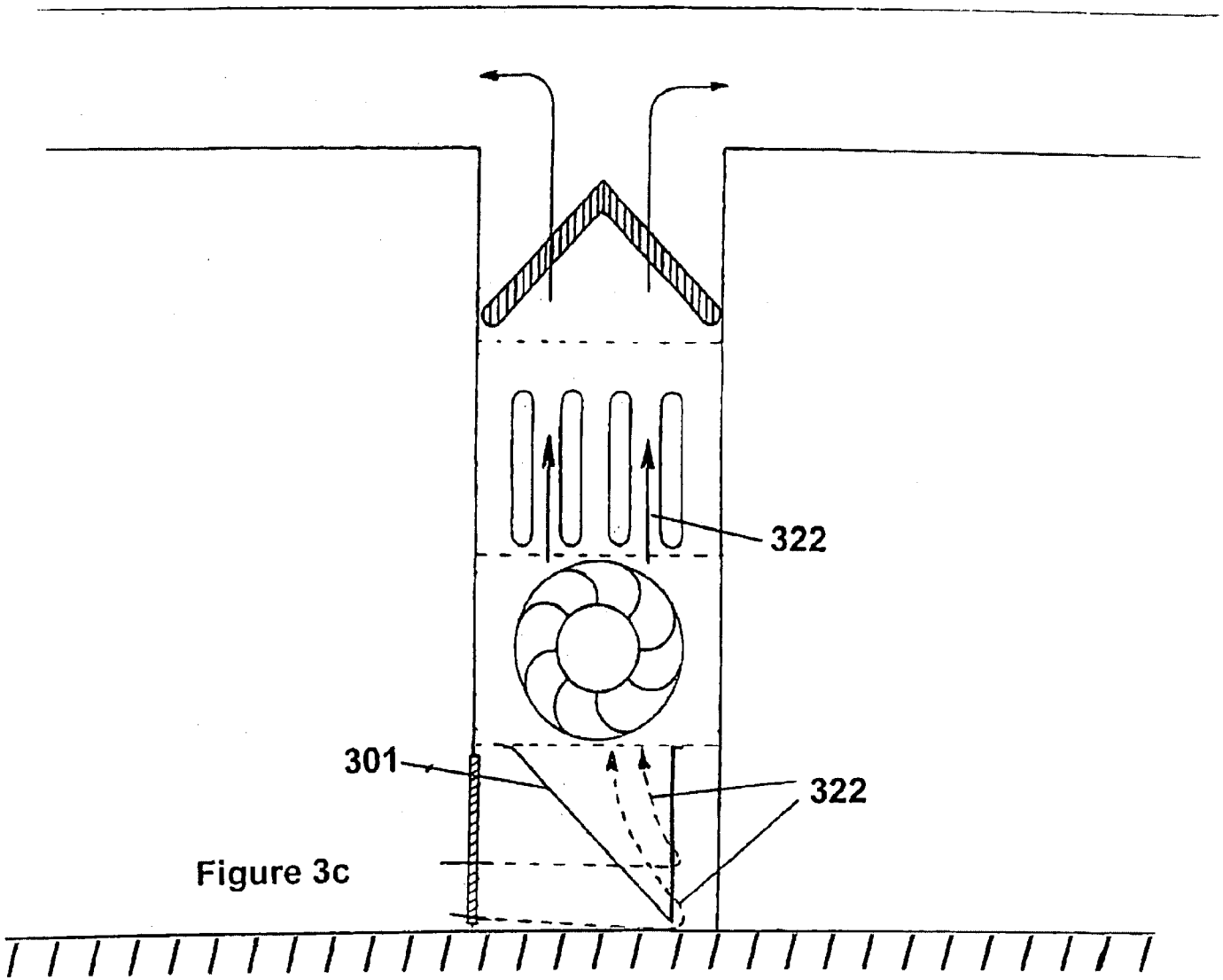
FIG. 3C is a side view of an HVAC heat exchange system with a triangular module installed under the blower fan.
Figure 4A:
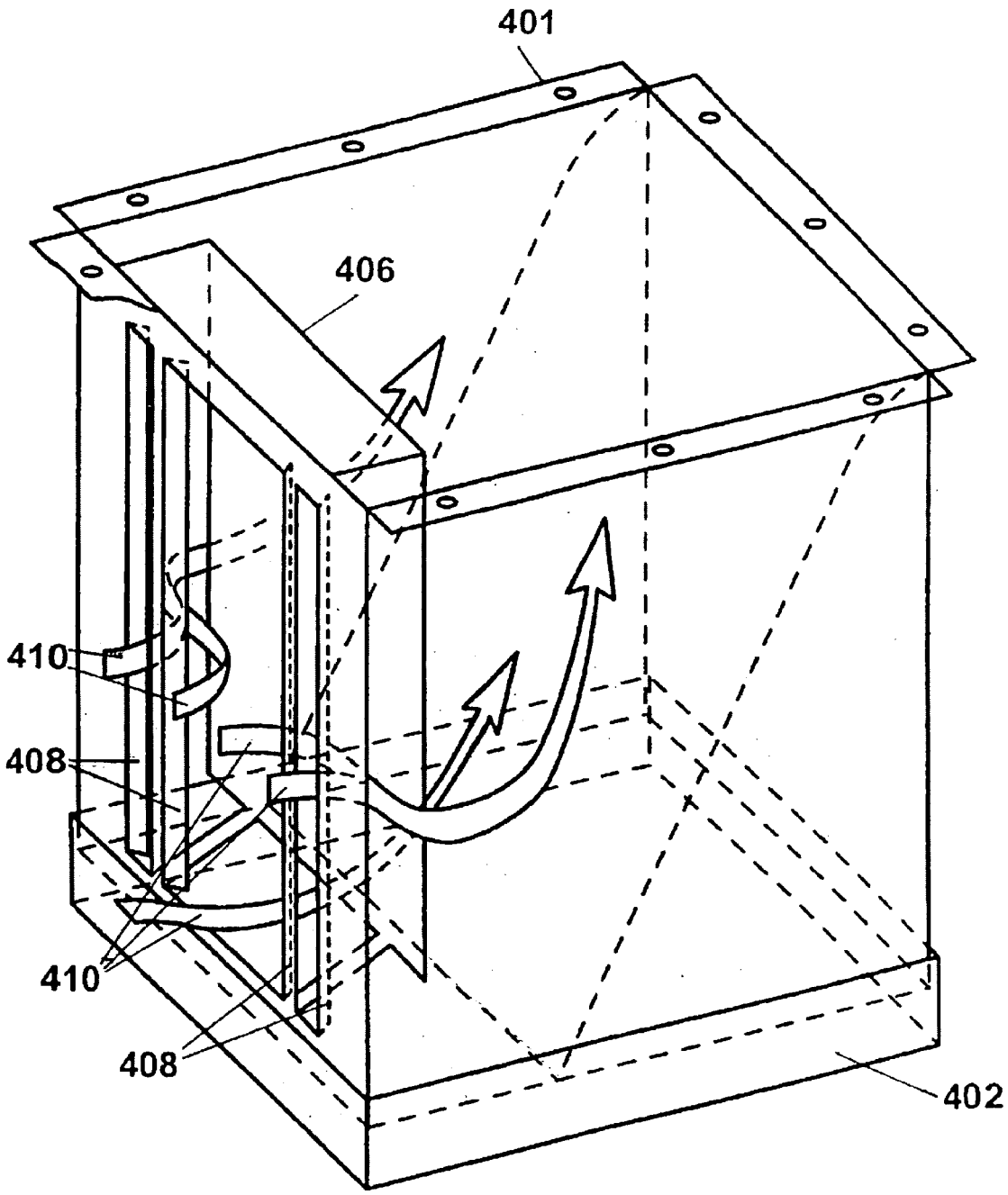
FIG. 4A is a three dimensional view of a square module.

FIG. 3C is a side view of an HVAC heat exchange system with triangular module 301 installed under the blower fan. Air flows in the direction indicated by arrows 322. FIG. 4A is a diagram illustrating a square acoustic attenuating module 401. The square module efficiently utilizes the limited workspace in the intake air duct section, and, as a result, a relatively thick (between about 15 and 40 inches, depending on the height and volume of the air duct) acoustical absorbing padding 402 can be installed. The noise spectrum of the blower fan and other mechanical parts can be empirically determined so that a particular thickness of acoustical absorbing padding can be installed to achieve satisfactory noise attenuation. Thicker acoustical absorbing padding results in broader frequency band absorption, especially in the lower frequency band. Primary reflecting panel 406 is offset between about 3 and 6 inches from the intake air duct opening and is preferably slightly bigger than the intake air duct opening. Reflecting panel 406 is disposed substantially parallel to the intake air duct opening. The arrangement of the primary reflecting panel 406 and secondary reflecting panels 408 greatly improves the confinement of the HVAC noise. The thick acoustical absorbing padding helps to attenuate the HVAC noise. This efficient arrangement of primary and secondary reflecting panels also allows intake air 410 to flow through the duct opening, past the secondary reflecting panels, and around the primary reflecting panel with little obstruction.

Figure 4B:
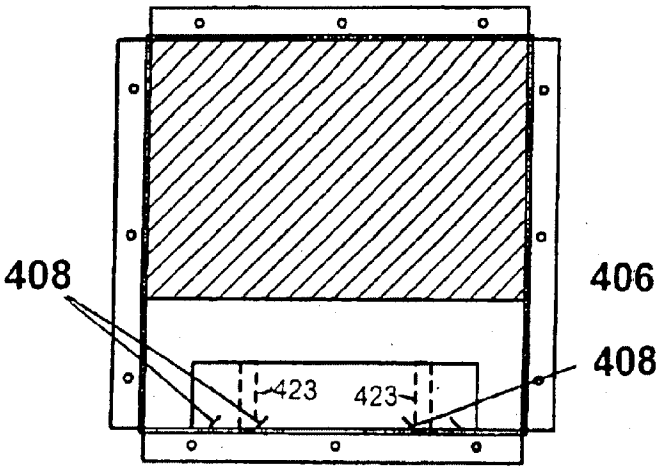
FIG. 4B is a top view of a square module.

FIG. 4B shows a top view of the square module. The primary reflecting panel 406 is spaced apart from sides of the duct opening by a pair of supports 423. Secondary reflecting panels 408 extend across the duct opening and are angled inward between about 45 and 90 degrees so that the secondary reflecting panels allow air to pass into the duct from outside and reflect sound that would otherwise leave the duct back into the intake air duct.

Figure 4C:
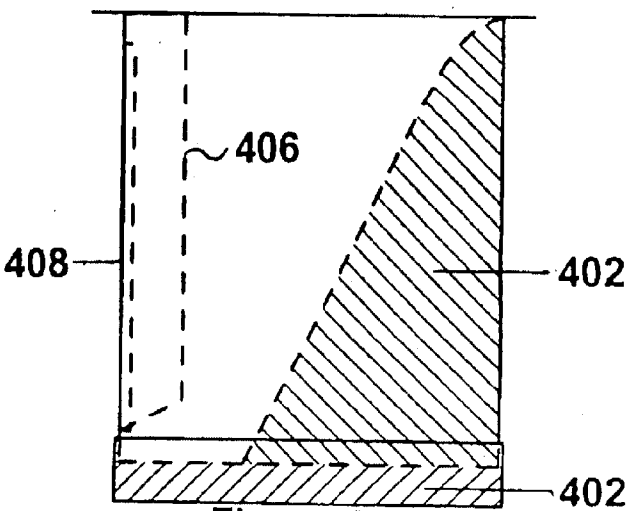
FIG. 4C is a side view of a square module.

FIG. 4C shows a side view of the square module. The square module efficiently uses the limited space available in the intake air duct. Therefore, it allows relatively thick acoustical absorbing padding 402 to be installed. Noise propagating down from the blower fan is absorbed by the padding and reflected back by primary reflecting panel 406. Noise that propagates past the primary reflecting panel to the duct opening is reflected back by secondary reflecting panels 408.

Figure 4D:
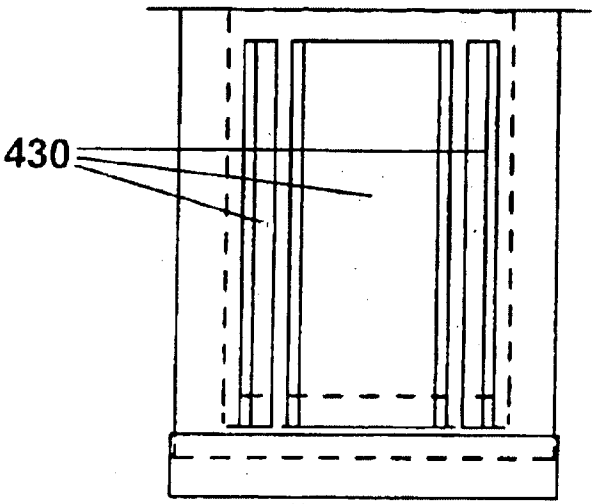
FIG. 4D is a front view of a square module.

FIG. 4D shows a front view of the square module. The large opening 430 located on the front of the square module allows air to flow through and past the secondary reflecting panels with minimum obstruction.

Figure 4E:
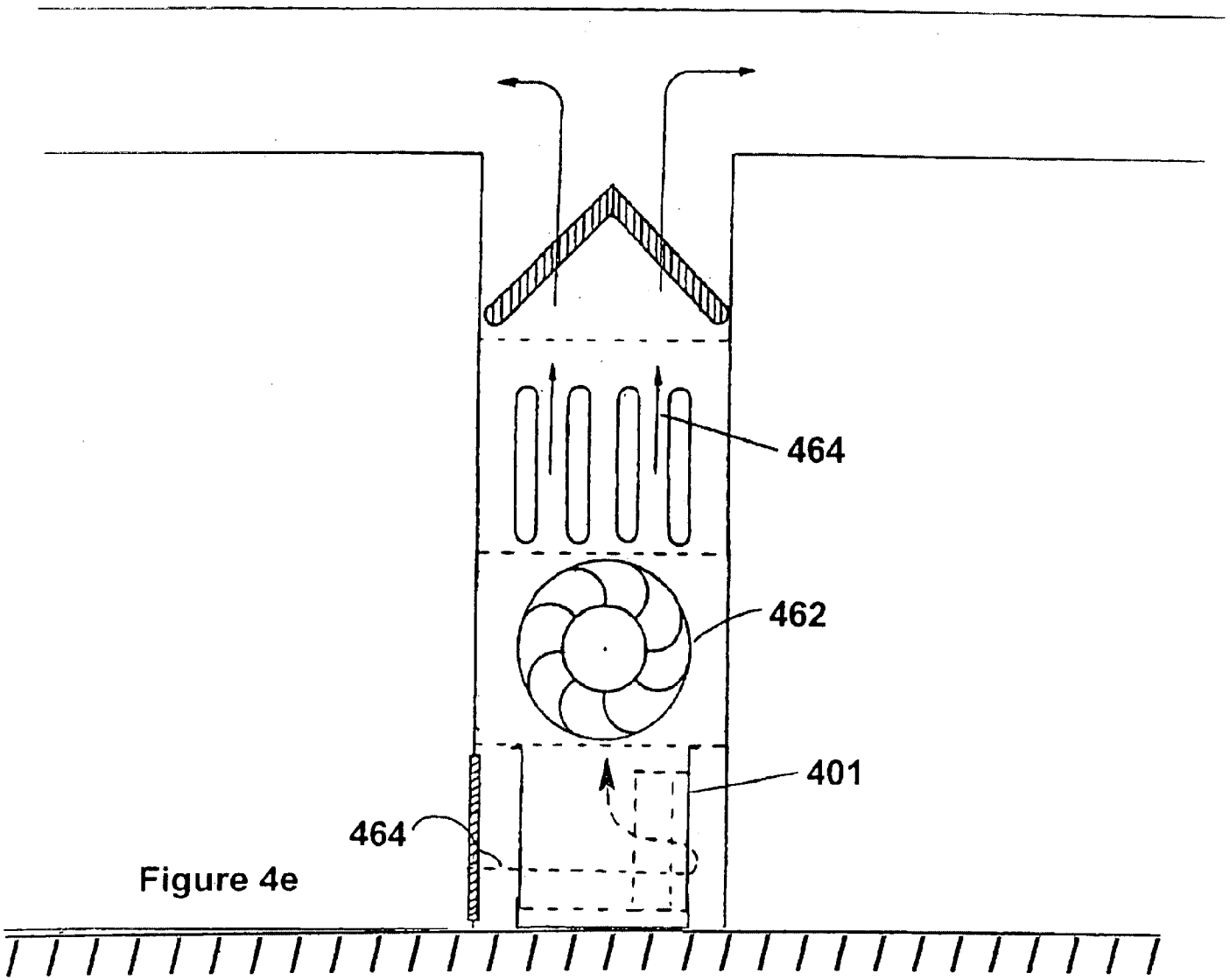
FIG. 4E is a side view of an HVAC heat exchange system with a square module installed under the blower.

FIG. 4E is a side view of an HVAC heat exchange system with square module 401 installed directly under blower 462. Air flows in the direction indicated by the arrows 464.

Figure 4F:
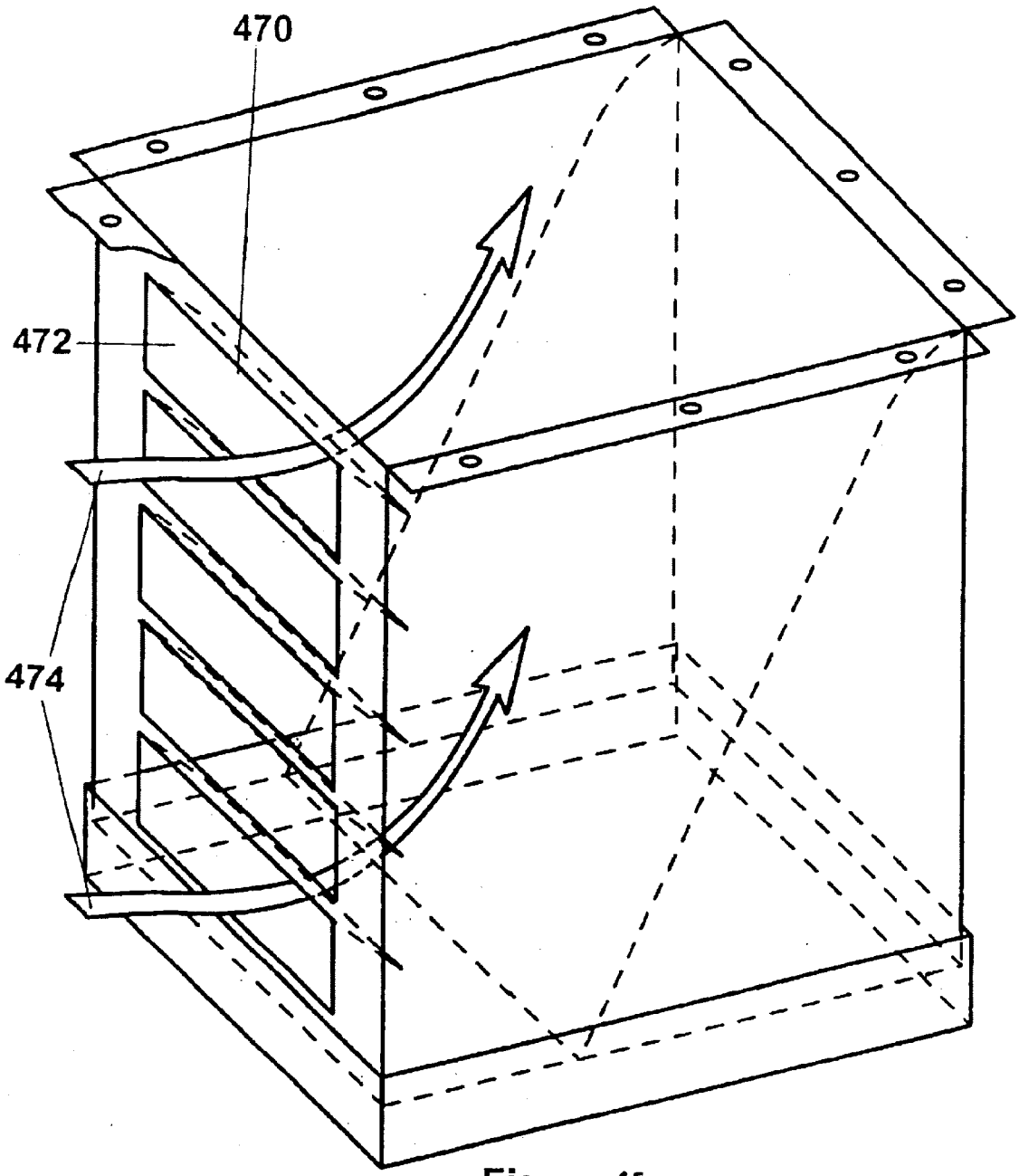
FIG. 4F illustrates an alternate arrangement of the primary and secondary panels wherein the primary and secondary reflecting panels have been replaced by a series of small reflecting shields.

FIG. 4F illustrates an alternative arrangement of a square module acoustic reflecting module. A series of small reflecting panels 470 fulfil the noise reflecting function of both the primary and secondary reflecting panels. This design allows air to flow through the duct opening with minimum obstruction.

Figure 4G:
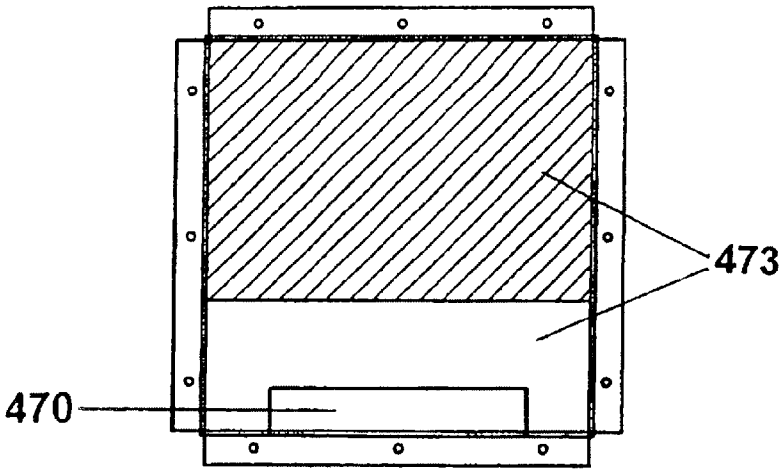
FIG. 4G is a top view of the alternate arrangement of the primary and secondary reflecting panels of the square module.

FIG. 4G shows a top view of the alternate square module. Reflecting panels 470 extends inward from the sides of the duct opening. Acoustical absorbing material 473 is disposed inside the module.

Figure 4H:
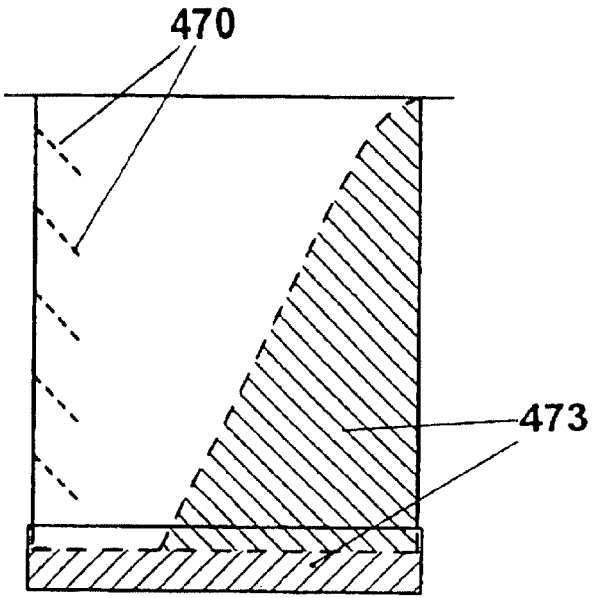
FIG. 4H is a side view of the alternate arrangement of the primary and secondary reflecting panels of the square module.

FIG. 4H shows a side view of the alternate square module. Reflecting panels 470 are shown extending inward at an angle between about 30 and 60 degrees relative to the front side of the square module. Acoustical absorbing material 473 is also shown inside the module.

Figure 4I:
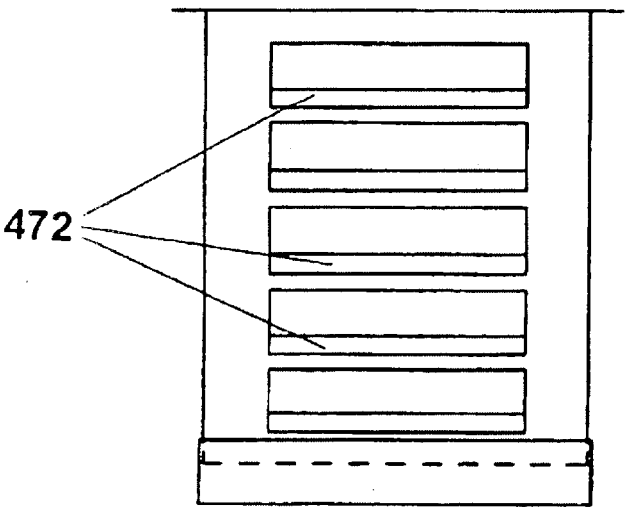
FIG. 4I is a front view of the alternate arrangement of the primary and secondary reflecting panels of the square module.

FIG. 4I shows a front view of the alternate square module. A series of openings 472 are shown that readily allow air to enter the module.

Figure 5A:
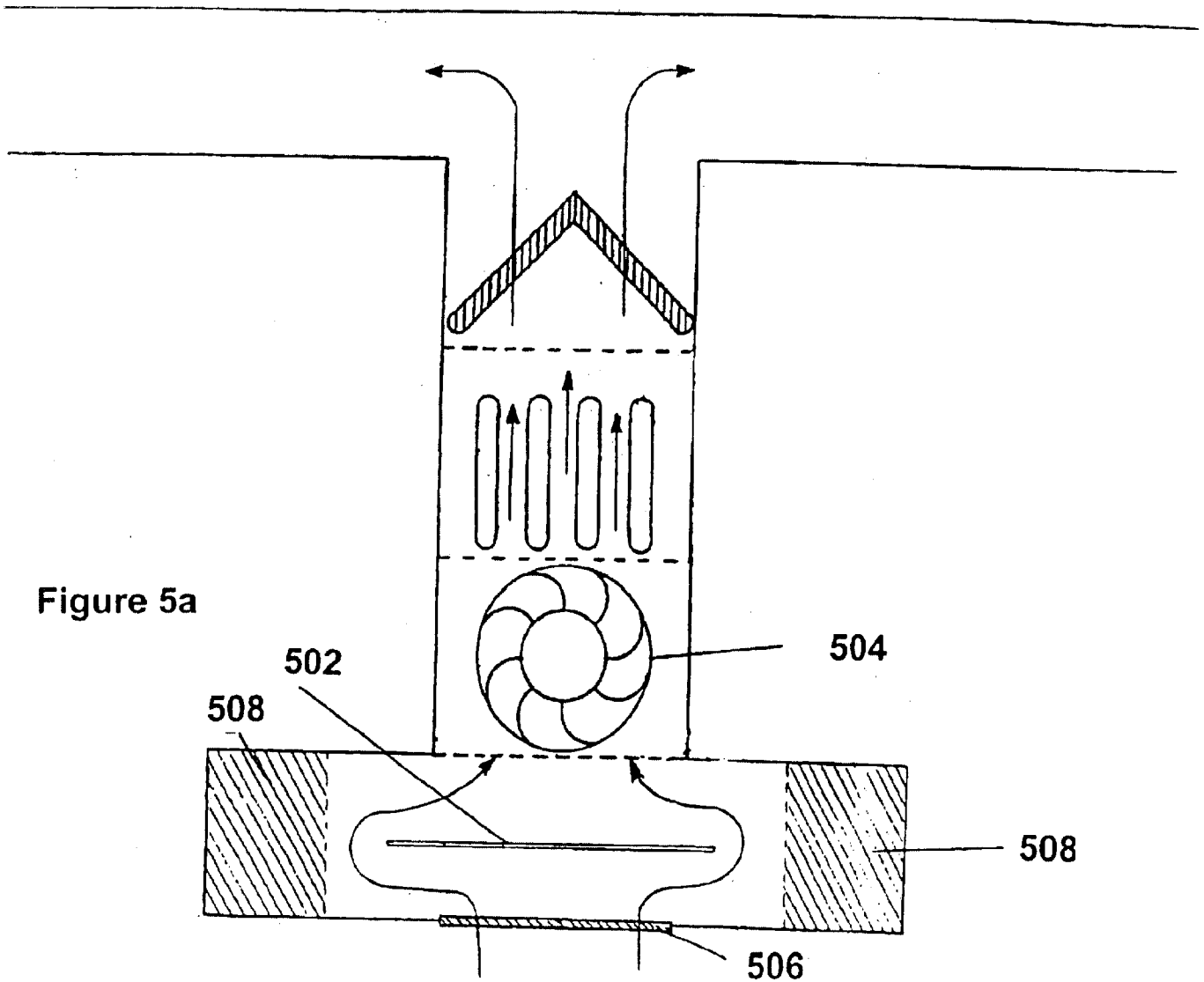
FIG. 5A is a side view of an HVAC heat exchange system wherein the air intake is in line with the blower fan and a deflecting panel is inserted in the air intake duct.

FIG. 5A illustrates another embodiment of the invention wherein the intake air filter opening is in line with the blower fan and the intake air duct workspace is sufficiently large to accommodate a large primary reflecting panel. Primary reflecting panel 502 is placed between blower fan 504 and intake air filter 506. This arrangement serves the purpose of preventing the HVAC noise from escaping directly into the living area unimpeded. Acoustical absorbing padding 508 is positioned at both ends of the module.

Figure 5B:
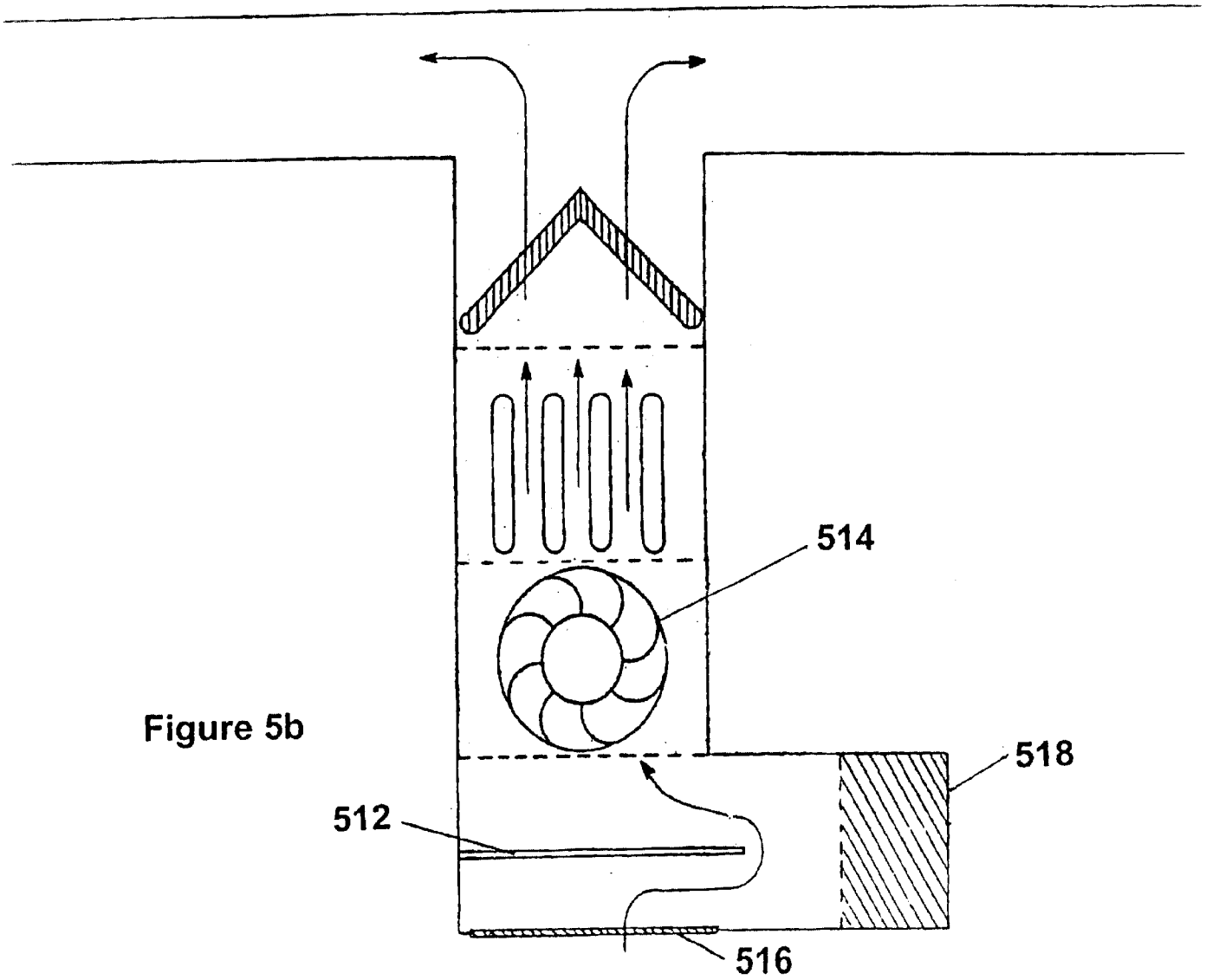
FIG. 5B is a side view of an HVAC heat exchange system wherein the air intake is in line with the blower fan and a deflecting panel is inserted in the air intake duct.

FIG. 5B illustrates another embodiment of the invention wherein the intake air filter opening is in line with the blower fan and the intake air duct workspace is sufficiently large to accommodate a large primary reflecting panel. Primary reflecting panel 512 is placed between blower fan 514 and intake air filter 516. This arrangement serves the purpose of preventing the HVAC noise from escaping directly into the living area unimpeded. Acoustical absorbing padding 518 is positioned at the end of the module.

In order to effectively attenuate the noise generated by a blower fan, which tends to be generated at about 200 Hz and above, the thickness of the acoustic absorbing padding is preferably selected so that the cutoff frequency for attenuation is lower than the lowest frequency of the noise generated. In one embodiment, the thickness of acoustical absorbing padding can be calculated as provided below.

The wavelength of the cutoff frequency for attenuation can be calculated by the relation:

$$\lambda = C/f$$

where C is the speed of sound in air (approximately around 1100 feet per second); f is the frequency in Hz, and $\lambda$ is the wavelength. Since C is approximately 1100 feet per second, a 200 Hz frequency will have a wavelength of approximately five and a half feet, which is equal to about 66 inches. Given the wavelength of the cutoff frequency, the preferred thickness of the acoustical absorbing padding can be determined. In one embodiment, a acoustical absorbing padding with a thickness equal to or greater than ¼ the wavelength of the cutoff frequency is used. For example, a ¼ wavelength padding thickness to achieve a 200 Hz frequency cutoff would equal about 16.5 inches. Depending on the noise spectrum of a given system with a given blower, the desired cutoff frequency and therefore the desired padding thickness may change.

Figure 6:
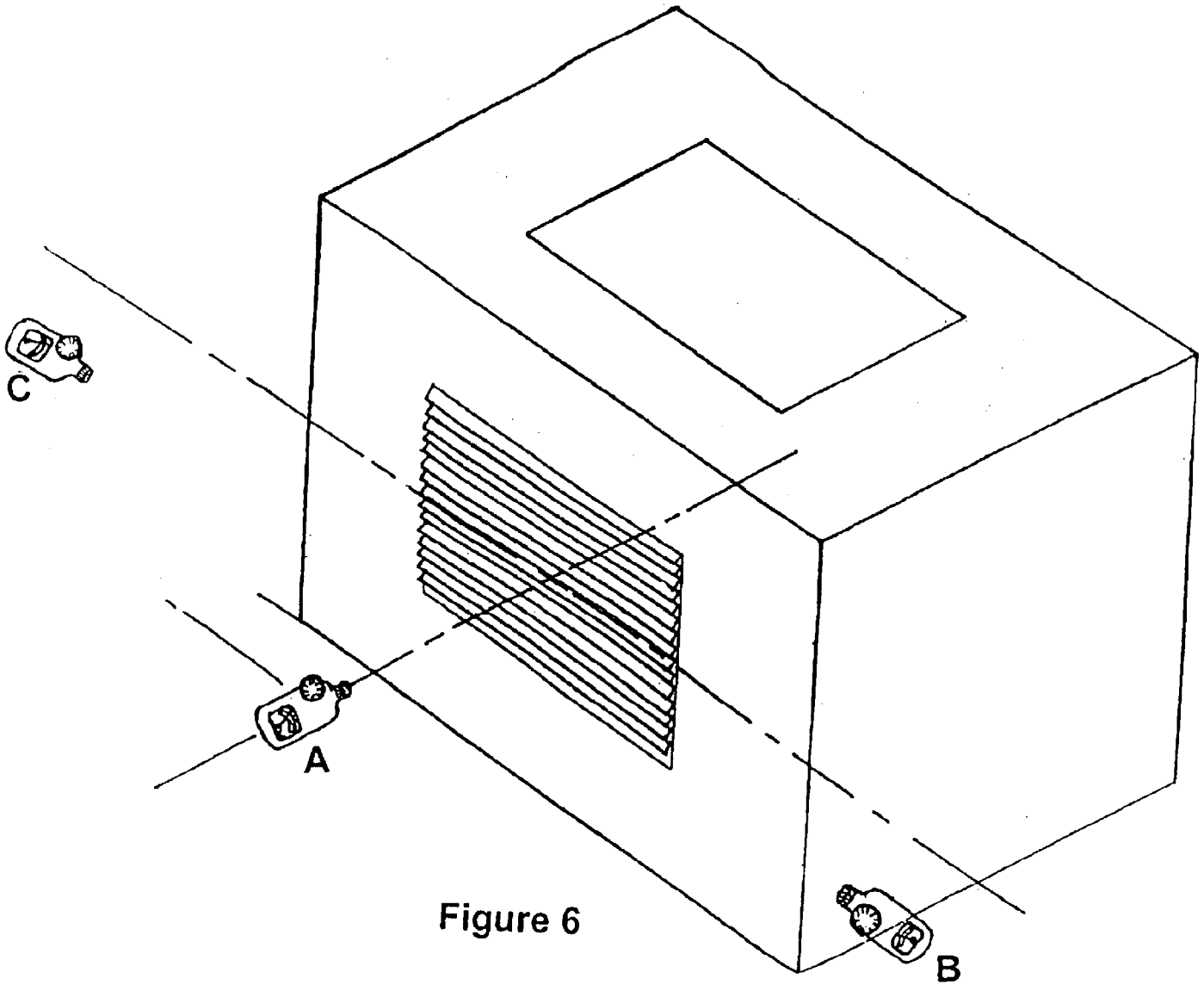
FIG. 6 is a three dimensional view of an air intake duct section.

FIG. 6 is a three dimensional view of an air intake duct section.

Techniques and devices have been described that provide broad band frequency noise attenuation. Noise generated by a blower fan that propagates to living space through the blower fan air intake duct is attenuated. An important advantage of the described designs is that while the propagation of noise is reduced, air flow is not substantially restricted.

Although the foregoing invention has been described in some detail for purposes of clarity of understanding, it will be apparent that certain changes and modifications may be practiced within the scope of the appended claims. It should be noted that there are many alternative ways of implementing both the process and apparatus of the present invention. Accordingly, the present embodiments are to be considered as illustrative and not restrictive, and the invention is not to be limited to the details given herein, but may be modified within the scope and equivalents of the appended claims.

What is claimed is:

1. An acoustic attenuator module configured to be housed within an intake air duct having an intake air duct opening comprising:

an open end having sides configured to be attached to passageway leading from the intake air duct to a blower fan;

an open side configured to allow air from the intake air duct opening to circulate through the module through the open end to the blower fan; and a primary reflecting plate offset from the open side to block noise propagated from the blower fan from propagating through the open side.

2. An acoustic attenuator module as recited in claim 1 further including acoustic absorbing material disposed between the open end and the open side and configured to attenuate noise propagated from the blower fan.

3. An acoustic attenuator module as recited in claim 1 further including acoustic absorbing material disposed between the open end and the open side and configured to deflect sound passing into the module around the primary reflecting plate.

4. An acoustic attenuator module as recited in claim 1 further including a secondary reflecting plate configured to reflect sound propagating around the primary reflecting plate from the blower away from the open side.

5. An acoustic attenuator module as recited in claim 1 further including a plurality of secondary reflecting plates configured to reflect sound propagating around the primary reflecting plate from the blower away from the open side.

6. An acoustic attenuator module as recited in claim 1 further including a secondary reflecting plate extending across the open side and inside the module.

7. An acoustic attenuator module as recited in claim 1 further including a plurality of secondary reflecting plates extending across the open side and inside the module.

8. An acoustic attenuator module configured to be housed within an intake air duct having an intake air duct opening comprising:

an open end having sides configured to be attached to a passageway leading from the intake air duct to a blower fan;

a primary reflecting side configured to reflect sound propagating from the blower fan through the open end away from the intake air duct opening; and an open side configured to allow air from the intake air duct opening to circulate around the module through the open side and the open end to the blower fan.

9. An acoustic attenuator module as recited in claim 8 further including secondary reflecting sides configured to reflect sound propagating from the blower fan through the open end away from the intake air duct opening.

* * * * *